US009708155B2

(12) United States Patent
Tokura et al.

(10) Patent No.: US 9,708,155 B2
(45) Date of Patent: Jul. 18, 2017

(54) ELEVATOR CONTROL DEVICE OF AN ONE-SHAFT MULTICAR SYSTEM

(75) Inventors: Sakurako Tokura, Tokyo (JP); Shingo Kobori, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 448 days.

(21) Appl. No.: 14/382,951

(22) PCT Filed: Mar. 23, 2012

(86) PCT No.: PCT/JP2012/057484

§ 371 (c)(1),
(2), (4) Date: Sep. 4, 2014

(87) PCT Pub. No.: WO2013/140598

PCT Pub. Date: Sep. 26, 2013

(65) Prior Publication Data

US 2015/0041255 A1 Feb. 12, 2015

(51) Int. Cl.
*B66B 9/00* (2006.01)
*B66B 1/24* (2006.01)
(Continued)

(52) U.S. Cl.
CPC ..... *B66B 1/2433* (2013.01); *B66B 1/468* (2013.01); *B66B 5/0031* (2013.01); *B66B 5/02* (2013.01)

(58) Field of Classification Search
CPC ... B66B 1/2433; B66B 1/468; B66B 15/0031; B66B 5/02
(Continued)

(56) References Cited

U.S. PATENT DOCUMENTS 5,865,274 A * 2/1999 Kiji ..... B66B 1/2458 187/249
6,273,217 B1 8/2001 Hikita
(Continued)

FOREIGN PATENT DOCUMENTS

EP 2 325 125 A1 5/2011
JP 01-020370 Y2 6/1989
(Continued)

OTHER PUBLICATIONS

International Preliminary Report on Patentability and Written Opinion issued Oct. 2, 2014, in International application No. PCT/JP2012/057484 (English translation only).
(Continued)

*Primary Examiner* — Anthony Salata
(74) *Attorney, Agent, or Firm* — Oblon, McClelland, Maier & Neustadt, L.L.P.

(57) ABSTRACT

An elevator control of a one-shaft multicar system includes: a collision predictor predicting occurrence of a collision of cars against each other in a same shaft in a case a predetermined collision prediction implementation condition is held; a waiting-with-door-open determination mechanism determining whether or not a car is caused to be on standby with the door thereof kept open in a case the collision predictor predicts the collision of cars against each other in the same shaft; a waiting-with-door-open floor determination mechanism determining a waiting-with-door-open floor of the car in a case the waiting-with-door-open determination mechanism determines the car is caused to be on standby with the door thereof kept open; and a controller causing at least either of the cars, for which occurrence of a collision is predicted, to be on standby with the door thereof kept open at the waiting-with-door-open floor determined by the waiting-with-door-open floor determination mechanism.

18 Claims, 4 Drawing Sheets

F1: DETECTION OF COLLISION PREDICTION CONDITION
F2: DOES COLLISION OCCUR?
F3: IS WAITING WITH DOOR OPEN NECESSARY?
F4: DETERMINATION OF WAITING-WITH-DOOR-OPEN FLOOR
F5: SENDING OF WAITING-WITH-DOOR-OPEN INSTRUCTION
F6: RECEIVING OF WAITING-WITH-DOOR-OPEN INSTRUCTION
F7: CARRYING-OUT OF WAITING-WITH-DOOR-OPEN ACTION

(51) Int. Cl.
*B66B 5/00* (2006.01)
*B66B 1/46* (2006.01)
*B66B 5/02* (2006.01)

(58) Field of Classification Search
USPC ..... 187/247, 249, 380–389, 391, 393
See application file for complete search history.

(56) References Cited

U.S. PATENT DOCUMENTS 7,353,914 B2 * 4/2008 Deplazes ..... B66B 5/0031 187/249
7,392,883 B2 * 7/2008 Hikita ..... B66B 1/2466 187/249
7,487,860 B2 * 2/2009 Hikita ..... B66B 1/2433 187/249
8,136,635 B2 * 3/2012 Christy ..... B66B 5/0031 187/249
8,230,977 B2 * 7/2012 Thumm ..... B66B 1/34 187/247
8,292,038 B2 * 10/2012 McCarthy ..... B66B 13/22 187/249
8,297,409 B2 * 10/2012 Hsu ..... B66B 1/2433 187/247
8,424,651 B2 * 4/2013 Brand ..... B66B 1/2466 187/249
8,905,195 B2 * 12/2014 Finschi ..... B66B 1/2458 187/249
2007/0089935 A1 4/2007 Hikita

FOREIGN PATENT DOCUMENTS

JP 06-305648 A 11/1994
JP 08-133611 A 5/1996
JP 2000-226164 A 8/2000
JP 2009-012883 A 1/2009
JP 4291370 B2 7/2009
JP 2009-274871 A 11/2009
WO 2006/025103 A1 3/2006
WO 2010/032307 A1 3/2010

OTHER PUBLICATIONS

International Search Report issued May 29, 2012 in PCT/JP2012/057484 filed Mar. 23, 2012.

* cited by examiner

10: GROUP MANAGEMENT CONTROL DEVICE
11: COLLISION PREDICTION SECTION
12: WAITING-WITH-DOOR-OPEN DETERMINATION SECTION
13: WAITING FLOOR DETERMINATION SECTION
20: EACH-CAR MANAGEMENT CONTROL DEVICE
21: CAR CONTROL SECTION

F1: DETECTION OF COLLISION PREDICTION CONDITION
F2: DOES COLLISION OCCUR?
F3: IS WAITING WITH DOOR OPEN NECESSARY?
F4: DETERMINATION OF WAITING-WITH-DOOR-OPEN FLOOR
F5: SENDING OF WAITING-WITH-DOOR-OPEN INSTRUCTION
F6: RECEIVING OF WAITING-WITH-DOOR-OPEN INSTRUCTION
F7: CARRYING-OUT OF WAITING-WITH-DOOR-OPEN ACTION

20: EACH-CAR MANAGEMENT CONTROL DEVICE
21: CAR CONTROL SECTION
22: DOOR CLOSING DEACTIVATING SECTION

ELEVATOR CONTROL DEVICE OF AN ONE-SHAFT MULTICAR SYSTEM

TECHNICAL FIELD

The present invention relates an elevator control device.

BACKGROUND ART

In a one-shaft multicar system elevator in which a plurality of cars are disposed in one shaft so as to ascend and descend freely, it is necessary to perform control in such a manner as to avoid a collision of cars against each other in the same shaft.

Therefore, there are known some conventional one-shaft multicar system elevators which are configured in such a manner that the run of cars in the direction in which the cars approach each other in the same shaft is prohibited and that in the case where there are passengers in the cars which run in the direction in which the cars approach each other in the same shaft, until the running direction of one car is reversed, the other car is caused to be on standby with the door thereof kept open (refer to Patent Literature 1, for example).

Also, there have hitherto been known some one-shaft multicar system elevators which are configured in such a manner that in generating a speed pattern of an assigned car which has been assigned to a call, in the case where there is a forward running car which runs ahead of the assigned car in the same direction as that of the assigned car in the same shaft, the run start time of the assigned car is delayed when the destination floor of the assigned car is beyond the position of the forward running car (refer to Patent Literature 2, for example).

Furthermore, there have hitherto been known some elevators which are configured in such a manner that a blockage division into which the entry of another car is prohibited is computed from information on the position and running direction of each car, whereby operation management is performed so that another car does not enter the blockage division of one car (refer to Patent Literature 3, for example).

CITATION LIST

Patent Literature

Patent Literature 1: Japanese Patent No. 4291370

Patent Literature 2: Japanese Patent Laid-Open No. 2009-012883

Patent Literature 3: Japanese Patent Laid-Open No. 08-133611

SUMMARY OF INVENTION

Technical Problem

However, in the conventional elevator control device described in Patent Literature 1, in the case where the two cars run in the direction in which the two cars approach each other in the same shaft, until the running direction of one car is reversed, the other car is constantly caused to be on standby. This results in the problem that the transportation efficiency of the elevator decreases.

Moreover, the conventional elevator control device described in Patent Literature 2 has the problem that delaying the run start time of the assigned car when the destination floor of the assigned car is beyond the position of a forward running car causes a decrease in the transportation efficiency of the elevator.

Similarly, the conventional elevator control device described in Patent Literature 3 has the problem that stopping another car before the entry into the blockage division of one car causes a decrease in the transportation efficiency of the elevator.

The present invention was made in order to solve these problems and an object thereof is to provide an elevator control device capable of efficiently avoiding the collision of cars against each other and thereby suppress a decrease in the operation efficiency caused by the avoidance of the collision.

Means for Solving the Problems

An elevator control device according to the present invention in a one-shaft multicar system elevator wherein a plurality of cars are disposed in one shaft so as to ascend and descend freely, includes: collision prediction means which predicts occurrence of a collision of cars against each other in the same shaft in the case where a predetermined collision prediction implementation condition is held; waiting-with-door-open determination means which determines whether or not a car is caused to be on standby with a door thereof kept open in the case where the collision prediction means predicts the occurrence of the collision of cars against each other in the same shaft; waiting-with-door-open floor determination means which determines a waiting-with-door-open floor of a car in the case where the waiting-with-door-open determination means determines that the car is caused to be on standby with the door thereof kept open; and control means which causes at least either of the cars, for which the occurrence of the collision is predicted, to be on standby with the door thereof kept open at the waiting-with-door-open floor determined by the waiting-with-door-open determination means.

Advantageous Effects of Invention

An elevator control device of the present invention produces the effect that in a one-shaft multicar system elevator, it is possible to efficiently avoid the collision of cars against each other and thereby to suppress a decrease in the operation efficiency caused by the avoidance of the collision.

DESCRIPTION OF EMBODIMENTS

Figure 1:
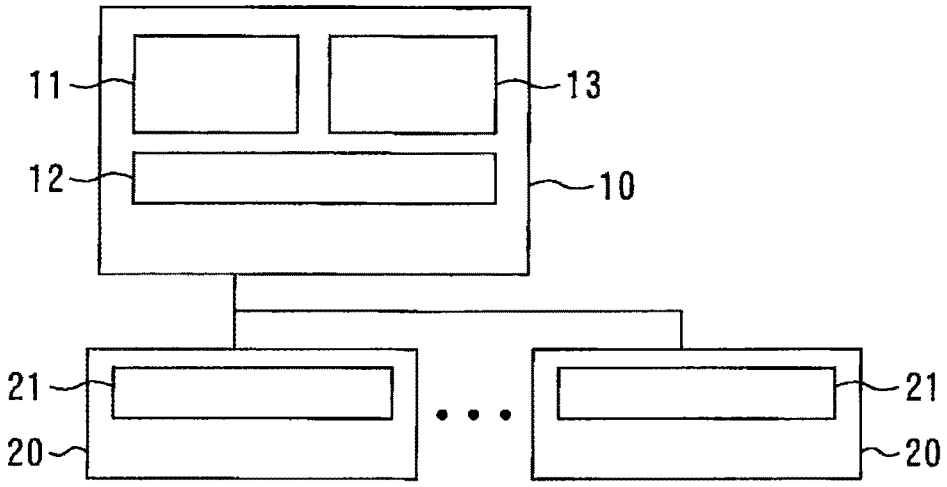
FIG. 1 is a block diagram showing the general configuration of the elevator control device related to Embodiment 1 of the present invention.

The present invention will be described with reference to the accompanying drawings. In each of the drawings, identical reference numerals refer to identical or corresponding parts and repeated descriptions of these parts are appropriately simplified or omitted.

Embodiment 1

Figure 2:
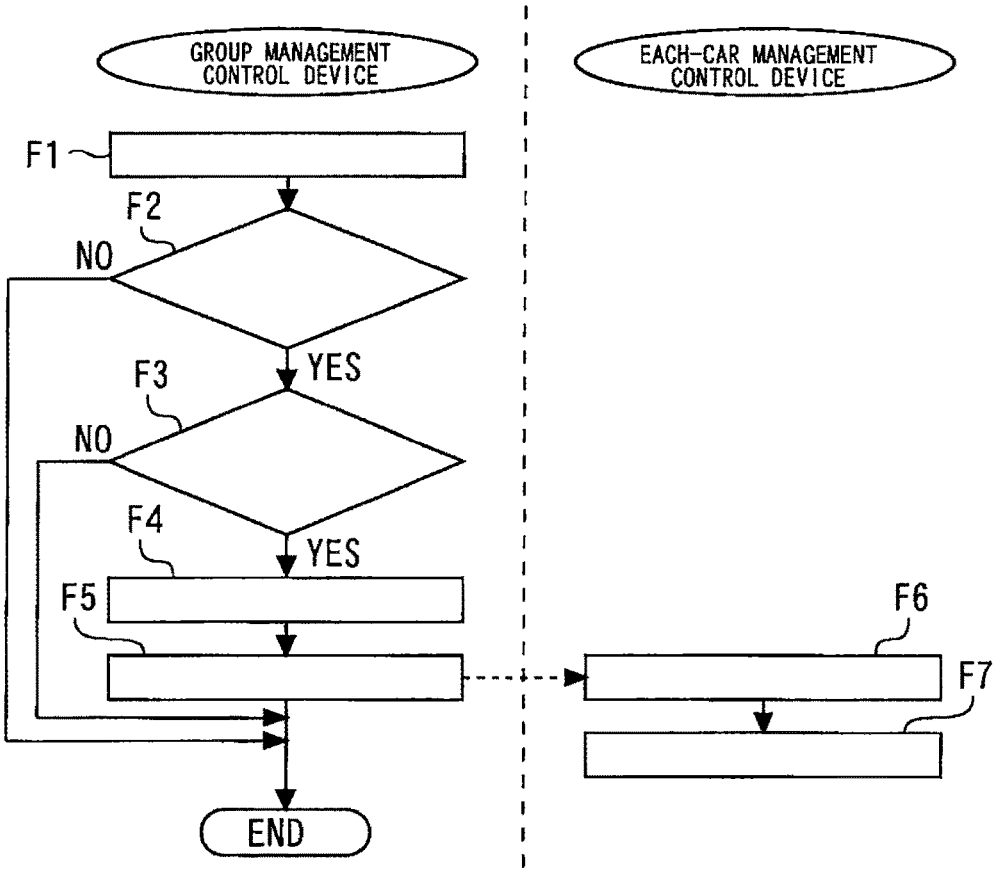
FIG. 2 is a flowchart showing actions of the elevator control device related to Embodiment 1 of the present invention.

FIGS. 1 and 2 relate to Embodiment 1 of the present invention. FIG. 1 is a block diagram showing the general configuration of the elevator control device and FIG. 2 is a flowchart showing actions of the elevator control device.

Elevators which become controlled objects of the elevator control device of the present invention are group-managed elevators in which operation management of a plurality of elevators is performed as a group. And furthermore, for a plurality of elevators constituting a group, a one-shaft multicar system is adopted in which a plurality of cars are disposed in one shaft in such a manner as to be capable of ascending and descending each independently.

FIG. 1 shows the configuration of the control device which controls the operation of such one-shaft multicar system elevators. In FIG. 1, reference numeral 10 denotes a group management control device in charge of the management control of a group consisting of a plurality of elevator cars. This group management control device 10 registers calls according to the contents of operations by users on operating panels which are installed in elevator halls and cars, and determines cars to be assigned to registered calls (assigned cars).

The operation of each car belonging to a group of cars, whose management is controlled by the group management control device 10, is controlled by each-car management control devices 20. The each-car management control devices 20 are provided in the same number as the number of cars in such a manner as to correspond to each of the cars. Each of the each-car management control devices 20 is provided with a car control section 21 for controlling mainly running actions and door opening and closing actions of cars.

The group management control device 10 and each of the each-car management control devices 20 are connected in such a manner as to be communicable. The group management control device 10 which has determined an assigned car to a call registration sends a call assignment instruction to the each-car management control device 20 which controls the assigned car in question. The car control section 21 of the each-car management control device 20 which has received this call assignment instruction performs control so that the assigned car is caused to respond to the call registration in accordance with the call assignment instruction.

The group management control device 10 is provided with a collision prediction section 11, a waiting-with-door-open determination section 12, and a waiting floor determination section 13.

The collision prediction means 11 predicts the occurrence of a collision of cars against each other in the same shaft in the case where a predetermined collision prediction implementation condition holds. On the basis of the present position and running condition (during a run or at a standstill, and when the car is running, the running direction) of each car, call registration condition, assignment condition of cars to call registrations and the like, this collision prediction section 11 predicts a collision of two cars against each other in the same shaft which might occur at the present time and in the future.

The prediction of a collision by this collision prediction section 11 is carried out each time a predetermined collision prediction implementation condition holds. This collision prediction implementation condition will be described by giving specific examples. First, the first example is such that when a new call occurs, the assignment of a car to this call is performed and condition component elements include whether or not a change in the predicted time of the arrival of each car at each floor is expected.

In this first example, the condition is set in such a manner that the prediction of a collision is performed when a change in the predicted time of the arrival of each car at each floor is expected. Or the condition may be set in such a manner that the predicted time of the arrival of each car at each floor is computed and that the prediction of a collision is performed when a change occurs actually at this predicted time of the arrival which was computed.

Next, the second example is such that condition component elements include whether or not the car which responded to the call stopped at the floor. In this second example, the condition is set in such a manner that the prediction of a collision is performed when the car responded to the call and arrived at the floor.

And the third example is such that condition component elements include whether or not a given time has elapsed after the prediction of a collision was carried out last time. In this third example, the condition is set in such a manner that the prediction of a collision is performed periodically each time a given time elapses.

It is possible to adopt any one of the above-described examples as the collision prediction implementation condition or the component elements in the above-described examples may be combined as composite conditions.

Figure 4:
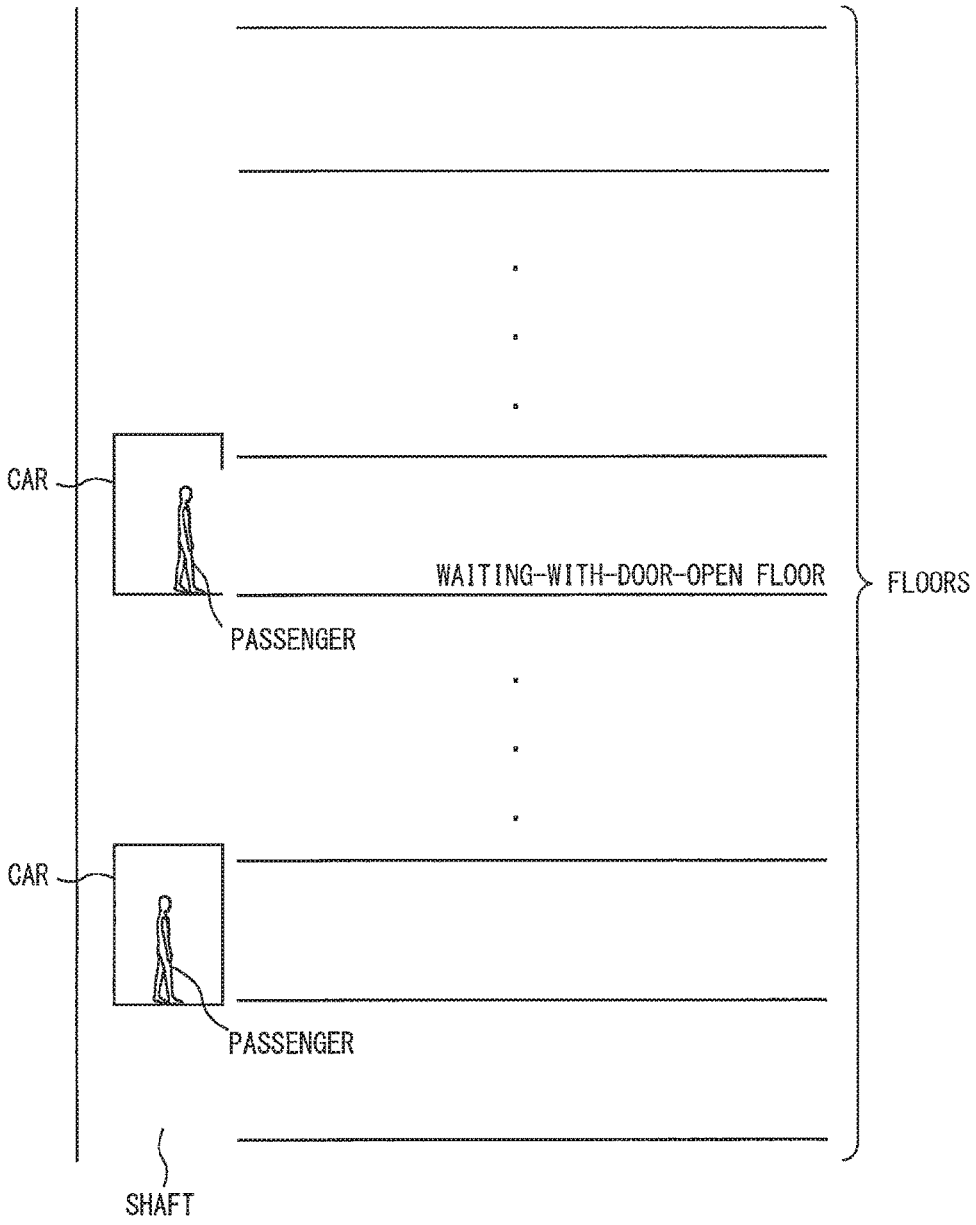
FIG. 4 is a perspective view of the one-shaft multicar elevator system.

The waiting-with-door-open determination section 12 is intended (as shown in FIG. 4), in the case where the collision prediction section 11 predicts the occurrence of a collision of cars against each other in the same shaft, for determining whether or not waiting-with-door-open of the cars is necessary in order to avoid this predicted collision. In the case where the collision prediction section 11 predicts the occurrence of a collision of cars against each other in the same shaft, this waiting-with-door-open determination section 12, first, determines whether or not waiting-with-door-open of the cars is necessary.

For example, in the case where one of the cars for which a collision is predicted carries no passenger and is at a standstill (has not responded to a call), all that is required is to evacuate this car to a position where a collision can be avoided, and in this case, the waiting of the cars is unnecessary.

Therefore, in the case where one of the cars for which a collision is predicted carries no passenger and is at a standstill (has not responded to a call), the waiting-with-door-open determination section 12 determines that the waiting of the cars is unnecessary. On the other hand, in the case where both of cars for which a collision is predicted carry passengers and/or are during a run, for at least one of the cars for which a collision is predicted, the waiting-with-door-open determination section 12 temporarily stops the run of the car in order to avoid the collision and determines that it is necessary to cause the car to be at a standby at any floor.

And when the waiting-with-door-open determination section 12 determines that the waiting of the cars is necessary, on the basis of a predetermined waiting-with-door-open determination condition, the waiting-with-door-open determination section 12 further determines whether or not the car door is kept open in this waiting, that is, whether or not this waiting is performed as waiting with door open.

This waiting-with-door-open determination condition will be described by giving specific examples. First, in the first example, the condition is set in such a manner that in the case of waiting, waiting with door open is constantly ensured. And in the second example, the condition is set in such a manner that in the case where both two cars for which a collision is expected carry passengers and the collision is to be avoided with the passengers in the cars, waiting with door open is ensured.

In the third example, whether or not waiting with the door thereof kept open is determined according to the time division of the day to which the present time belongs. In this third example, the condition is set in such a manner that, for example, in the case where the present time belongs to congestion hours, waiting with door open is carried out when the elevator use ratio is relatively high, and that waiting with door open is not carried out when the present time belongs to hours during which the number of passengers is small and the elevator use ratio is relatively low.

And the fourth example is such that whether or not waiting with door open is determined according to the congestion condition of the elevator. In this fourth example, the condition is set in such a manner that, for example, waiting with door open is carried out during congestion when the degree of elevator congestion is not less than a predetermined reference value, whereas waiting with door open is carried out when the degree of elevator congestion is smaller than a predetermined reference value.

Also in this waiting-with-door-open determination condition, as with the collision prediction implementation condition, it is possible to adopt any one of the above-described examples or the conditions in the above examples may be combined as composite conditions.

When the waiting-with-door-open determination section 12 determines that a car is caused to be on standby with the door thereof kept open, on the basis of a predetermined waiting-with-door-open floor determination condition, the waiting-with-door-open determination section 12 determines a floor at which a car is caused to be on standby with the door thereof kept open (a waiting-with-door-open floor).

This waiting-with-door-open floor determination condition will be described by giving specific examples. First, the first example is such that the condition is set in such a manner that a floor for which a call has been registered and the boarding or alighting of passengers is expected, is determined as a waiting-with-door-open floor. That is, in this first example, the waiting floor determination section 13 determines a floor for which a collision of cars against each other can be avoided by performing waiting as a waiting-with-door-open floor among those at which a stop has been decided due to a registered call concerning the car for which waiting-with-door-open is to be performed.

Next, the second example is such that the condition is set in such a manner that a floor for which the possibility (probability) that the boarding or alighting of passengers occurs is expected to be high, is determined as a waiting-with-door-open floor. In this second example, the group management control device 10 is provided with storage means for storing a past elevator use condition. In this storage means information is stored concerning an elevator use condition, for example, as to at which floor and how many times elevators stopped for each day of the week and for each time division of the day.

And on the basis of the information concerning an elevator use condition stored in this storage means, the waiting floor determination section 13 selects floors at which a car performing waiting with door open stops and for which the possibility that the boarding or alighting of passengers occurs is expected to be high, and determines a floor for which a collision of cars against each other can be avoided by performing waiting among the selected floors as a waiting-with-door-open floor.

The fourth example of a waiting-with-door-open floor determination condition is such that a waiting-with-door-open floor is determined according to the elevator congestion condition. In this fourth example, for example, the degree of congestion in the hall of each floor is computed using a camera image and the like, and a floor at which the degree of congestion in the hall is high is determined as a waiting-with-door-open floor.

The fifth example of a waiting-with-door-open floor determination condition is such that in the case where all passengers alight from a car and the car becomes empty, the condition is set in such a manner that a floor at which no one is expected to board the car (the possibility that the boarding of passengers occurs is low) is set as a waiting-with-door-open floor. In the examples of a waiting-with-door-open floor determination condition described above, as a rule, a floor for which the possibility that the boarding of passengers occurs is high is determined as a waiting-with-door-open floor. However, even when a new passenger boards an empty car which is on standby with the door thereof kept open, it is impossible to cause the car run immediately because a collision needs to be avoided; therefore, this may give passengers the feeling of anxiety, the feeling of discomfort and the like. Hence, in the case where a car is empty, by making a floor for which the possibility that boarding of passengers occur is low a waiting-with-door-open floor, it is possible to ensure that when a car is on standby with the door thereof kept open, passengers do not board the car as far as possible.

Also for this waiting-with-door-open floor determination condition, in the same manner as the collision prediction implementation condition and the waiting-with-door-open determination condition, it is possible to adopt any one of the above-described examples or the conditions in the above examples may be combined as composite conditions.

When a waiting-with-door-open floor has been determined in this manner, the group management control device 10 sends a waiting-with-door-open instruction to the each-car management control device 20 which controls the car to perform the waiting-with-door-open. The car control section 21 of the each-car management control device 20 controls the car so as to cause the car to be on standby with the door thereof kept open at the waiting-with-door-open floor determined by the waiting floor determination section 13 in accordance with the received waiting-with-door-open instruction.

The flowchart of FIG. 2 shows actions of the elevator control device in this embodiment.

First, when in Step F1 the group management control device 10 detects that the collision prediction implementation condition holds, the flow of actions proceeds to Step F2. In Step F2, the collision prediction section 11 of the group management control device 10 predicts whether or not a collision of cars against each other in the same shaft occurs. And in the case where the collision prediction section 11 predicts that a collision of cars against each other in the same shaft does not occur, a series of actions comes to an end. On the other hand, in the case where the collision prediction section 11 predicts the occurrence of a collision of cars against each other in the same shaft, the flow of actions proceeds to Step F3.

In Step F3, on the basis of the waiting-with-door-open determination condition, the waiting-with-door-open determination section 12 of the group management control device 10 determines whether or not waiting of a car with door open is necessary in order to avoid the collision predicted in Step F2. And in the case where it is determined that waiting of the car with door open is unnecessary, a series of actions comes to an end. On the other hand, in the case where it is determined that waiting of the car with door open is necessary, the flow of actions proceeds to Step F4.

In Step F4, on the basis of the waiting-with-door-open floor determination condition, the waiting floor determination section 13 of the group management control device 10 determines a waiting-with-door-open floor of the car. And the flow of actions proceeds to Step F5, in which the group management control device 10 sends, to the each-car management control device 20 which controls cars performing waiting with door open, a waiting-with-door-open instruction to cause the car to be on standby with the door thereof kept open at the waiting-with-door-open floor determined in Step F4.

The waiting-with-door-open instruction sent from the group management control device 10 is received in Step F6 by the each-car management control device 20. And the flow of actions proceeds to Step F7, in which the car control section 21 of the each-car management control device 20 performs control in accordance with the received waiting-with-door-open instruction so that the car is caused to be on standby with the door thereof kept open at the waiting-with-door-open floor, whereby a waiting-with-door-open action is carried out.

The elevator control device configured as described above in a one-shaft multicar system elevator is provided with: collision prediction means for predicting the occurrence of a collision of cars against each other in the same shaft in the case where a predetermined collision prediction implementation condition holds; waiting-with-door-open determination means for determining whether or not a car is caused to be on standby with the door thereof kept open in the case where the collision prediction means predicts a collision of cars against each other in the same shaft; waiting-with-door-open floor determination means for determining a waiting-with-door-open floor of a car in the case where the waiting-with-door-open determination means determines that a car is caused to be on standby with the door thereof kept open; and control means for causing at least either of the cars, for which the occurrence of a collision is predicted, to be on standby with the door thereof kept open at the waiting-with-door-open floor determined by the waiting-with-door-open determination means.

For this reason, in the case where a collision of cars against each other is predicted and waiting with door open is necessary, it is possible to appropriately cause a car during a run to be on standby with the door thereof kept open, to efficiently avoid a collision of cars against each other, and thereby to suppress a decrease in the operation efficiency caused by the avoidance of the collision as much as possible.

And in particular, by using a floor for which it is expected from the present call registration condition and past use condition that the possibility that the boarding or alighting of passengers is high as a floor at which a car is caused to be on standby with the door thereof kept open, it is possible to further reduce the effect of the waiting for avoiding a collision on the operation efficiency.

Embodiment 2

Figure 3:
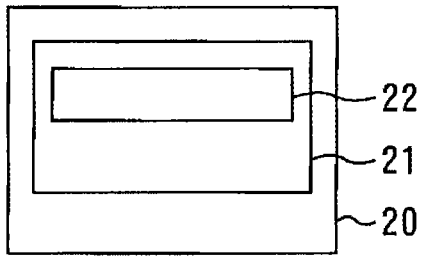
FIG. 3 is a block diagram showing the configuration of an each-car management control device provided in the elevator control device related to Embodiment 2 of the present invention.

FIG. 3 relates to Embodiment 2 of the present invention and is a block diagram showing the configuration of an each-car management control device provided in the elevator control device.

In Embodiment 2 described here, in addition to the configuration of Embodiment 1 described above, in performing waiting with door open for avoiding a collision, a door close button of a car operating panel is made ineffective until a predetermined time elapses after the start of door opening, whereby it is ensured that waiting with door open is positively carried out until the time necessary for avoiding a collision elapses.

That is, as shown in FIG. 3, the car control function 21 of the each-car management control device 20 is provided with a door closing deactivating section 22. This door closing deactivating section 22 makes ineffective the door close button provided on the car operating panel until a predetermined door closing deactivating time elapses after the a car starts waiting with door open. Therefore, even when a user in a car operates the door close button, this door closing operation is made ineffective and the car door is not closed, whereby the door open condition is maintained.

This predetermined door closing deactivating time may be a given time which is set beforehand or may also be an appropriate time set each time waiting with door open is carried out as described below. That is, the above-described predetermined door closing deactivating time may be set in such a manner that when in the group management control device 10 a waiting-with-door-open instruction is issued, a waiting time required for avoiding a collision is calculated and the door closing deactivating time becomes not less than this calculated waiting time.

In this manner, a door closing operation by a passenger in the car is made ineffective until the door closing deactivating time elapses during the waiting with door open, and it is possible to maintain the door open condition during the waiting for avoiding a collision. And after waiting is performed until the time necessary for avoiding a collision elapses, the run to a destination floor toward which the car was running before the waiting is started again.

Other configurations and actions are the same as in Embodiment 1 and detailed descriptions thereof are omitted.

The elevator control device configured as described above is such that in the configuration of Embodiment 1, there is provided door closing deactivating means which makes a door closing operation by a passenger ineffective during the predetermined door closing deactivating time in causing a car to be on standby with the door thereof kept open at a waiting-with-door-open floor.

For this reason, the same effect as in Embodiment 1 can be produced. In addition, furthermore, by making door closing by a passenger ineffective during the waiting for avoiding a collision, it is possible to maintain the door open condition for a time as long as possible.

And maintaining the door open condition during the waiting for preventing a collision enables the boarding or alighting of passengers at a waiting floor to be smoothly performed, and it is possible to improve the operation efficiency and convenience of an elevator. As described in Embodiment 1, this is especially effective in the case where a floor for which it is expected from the present call registration condition and past use condition that the possibility that the boarding or alighting of passengers is high, is used as a waiting-with-door-open floor.

INDUSTRIAL APPLICABILITY

The present invention can be used in a one-shaft multicar system elevator wherein a plurality of cars are disposed in one shaft so as to ascend and descend freely.

DESCRIPTION OF SYMBOLS

10 group management control device
11 collision prediction section
12 waiting-with-door-open determination section
13 waiting floor determination section
20 each-car management control device
21 car control section
22 door closing deactivating section

The invention claimed is:

1. An elevator control device in a one-shaft multicar system elevator wherein a plurality of cars are disposed in one shaft so as to ascend and descend freely, comprising:

collision prediction means which predicts occurrence of a collision of cars against each other in the same shaft in the case where a predetermined collision prediction implementation condition is held;

waiting-with-door-open determination means which determines whether or not a car is caused to be on standby with a door thereof kept open in the case where the collision prediction means predicts the occurrence of the collision of cars against each other in the same shaft;

waiting-with-door-open floor determination means which determines a waiting-with-door-open floor of a car in the case where the waiting-with-door-open determination means determines that the car is caused to be on standby with the door thereof kept open; and control means which causes at least either of the cars, for which the occurrence of the collision is predicted, to be on standby with the door thereof kept open at the waiting-with-door-open floor determined by the waiting-with-door-open determination means, wherein the waiting-with-door-open floor determination means determines, from a past use condition, a floor for which the possibility of the occurrence of boarding or alighting of passengers is high as the waiting-with-door-open floor.

2. The elevator control device according to claim 1, wherein the waiting-with-door-open floor determination means determines the waiting-with-door-open floor on the basis of the congestion condition of the elevator.

3. The elevator control device according to claim 1, wherein the waiting-with-door-open determination means determines that, in the case where passengers are present in both of the cars for which the occurrence of the collision is predicted, the car is caused to be on standby with the door thereof kept open.

4. The elevator control device according to claim 1, wherein the waiting-with-door-open determination means determines that, in the case where the collision prediction means predicts the collision of cars against each other in the same shaft, the car is constantly caused to be on standby with the door thereof kept open.

5. The elevator control device according to claim 1, wherein the waiting-with-door-open determination means determines whether or not the car is caused to be on standby with the door thereof kept open on the basis of a present time division of the day.

6. The elevator control device according to claim 1, wherein the waiting-with-door-open determination means determines whether or not the car is caused to be on standby with the door thereof kept open on the basis of the congestion condition of the elevator.

7. The elevator control device according to claim 1, wherein the predetermined collision prediction implementation condition is that there is a change in a predicted time of arrival of a car at a floor due to a call registration.

8. The elevator control device according to claim 1, wherein the predetermined collision prediction implementation condition is that a car has arrived at a floor in response to a call.

9. The elevator control device according to claim 1, wherein the predetermined collision prediction implementation condition is that a predetermined given time has elapsed after a collision prediction was carried out last time.

10. The elevator control device according to claim 1, wherein the control means includes door closing deactivating means which makes inactive a door closing operation by a passenger during a predetermined door closing deactivating time when the car is caused to be on standby with the door thereof kept open at the waiting-with-door-open floor.

11. The elevator control device according to claim 2, wherein the waiting-with-door-open determination means determines that, in the case where passengers are present in both of the cars for which the occurrence of the collision is predicted, the car is caused to be on standby with the door thereof kept open.

12. The elevator control device according to claim 2, wherein the waiting-with-door-open determination means determines that, in the case where the collision prediction means predicts the collision of cars against each other in the same shaft, the car is constantly caused to be on standby with the door thereof kept open.

13. The elevator control device according to any of claim 2, wherein the waiting-with-door-open determination means determines whether or not the car is caused to be on standby with the door thereof kept open on the basis of a present time division of the day.

14. The elevator control device according to claim 2, wherein the waiting-with-door-open determination means determines whether or not the car is caused to be on standby with the door thereof kept open on the basis of the congestion condition of the elevator.

15. The elevator control device according to claim 2, wherein the predetermined collision prediction implementation condition is that there is a change in a predicted time of arrival of a car at a floor due to a call registration.

16. The elevator control device according to claim 2, wherein the predetermined collision prediction implementation condition is that a car has arrived at a floor in response to a call.

17. The elevator control device according to claim 2, wherein the predetermined collision prediction implementation condition is that a predetermined given time has elapsed after a collision prediction was carried out last time.

18. The elevator control device according to claim 2, wherein the control means includes door closing deactivating means which makes inactive a door closing operation by a passenger during a predetermined door closing deactivating time when the car is caused to be on standby with the door thereof kept open at the waiting-with-door-open floor.

* * * * *